US005225627A

United States Patent [19]

Phillips et al.

[11] Patent Number: 5,225,627

[45] Date of Patent: Jul. 6, 1993

[54] TAILORED MUNITION EJECTION SYSTEM

[75] Inventors: William H. Phillips, Scottsdale; Thomas Palen, Mesa, both of Ariz.

[73] Assignee: Talley Defense Systems, Incorporated, Mesa, Ariz.

[21] Appl. No.: 573,099

[22] Filed: Aug. 24, 1990

[51] Int. Cl.[5] ..... F42B 4/06

[52] U.S. Cl. ..... 102/351; 102/357; 102/289

[58] Field of Search ..... 102/350, 351, 357, 289

[56] References Cited

U.S. PATENT DOCUMENTS

| | | | |
|---|---|---|---|
| 2,972,946 | 2/1961 | Poulter | 102/7.2 |
| 3,163,113 | 12/1964 | Davis et al. | 102/289 |
| 3,295,444 | 1/1967 | Cushing et al. | 102/7.2 |
| 3,461,801 | 8/1969 | Vitale et al. | 102/37.6 |
| 3,631,803 | 1/1971 | Davis | 102/70 R |
| 3,646,889 | 3/1972 | Davis | 102/70 B |
| 3,943,854 | 3/1976 | Zwicker | 102/34.4 |
| 3,999,379 | 12/1976 | LeFebvre | 60/204 |
| 4,335,656 | 6/1982 | Beatty et al. | 102/351 X |
| 4,380,197 | 4/1983 | Eaton | 102/228 |
| 4,455,943 | 6/1984 | Pinson | 102/489 |
| 4,619,199 | 10/1986 | Giladett | 102/254 |
| 4,688,486 | 8/1987 | Hall et al. | 102/489 |
| 4,690,060 | 9/1987 | Dietrich | 102/352 |
| 4,714,020 | 12/1987 | Hertsgaard et al. | 102/351 |
| 4,952,341 | 8/1990 | Sayles | 264/3.1 |
| 5,033,390 | 7/1991 | Minert et al. | 102/357 X |

*Primary Examiner*—Peter A. Nelson

*Attorney, Agent, or Firm*—Pennie & Edmonds

[57] ABSTRACT

This invention provides a system and method for ejecting munitions from carrier weapon housings through the inflation of inflatable bags, without imparting excessive acceleration loads to the munitions. The current invention combines the features of a ballistically tailored propellant grain with control nozzles to provide hot gases to an inflatable bladder in a fashion that permits control and tailoring of the acceleration pulse.

25 Claims, 19 Drawing Sheets 1
2
4
6
7
8

TAILORED MUNITION EJECTION SYSTEM

FIELD OF THE INVENTION

This invention relates to methods and apparatus for ejecting munitions from carrier housings, primarily for military purposes.

BACKGROUND OF THE INVENTION

Carrier weapon systems are those which employ a warhead unit containing one or more munitions to deliver those munitions to a point where they are deployed by ejection from the carrier housing either separately or all at once.

Various mechanisms have been devised to release and eject munitions from carrier weapon systems. Such mechanisms require two basic features to carry out that task. First, the munitions are retained in the carrier housing and remain so until they are to be deployed. Thus, it is necessary to disengage the munitions from the housing when the time of deployment arrives. Second, the munitions must be ejected from the housing.

The delivery of large length to diameter ratio munitions has particularly necessitated the development of such lateral and radial ejection systems for use with missile and dispenser delivery systems. This development, in combination with the use of soft munitions (i.e., munitions which can not withstand high acceleration loads during ejection) has presented a technical challenge. Most current lateral and radial ejection systems employ some type of inflatable bladder system to impart the expulsion force to the munition. Most of these bladders have been cylindrical in configuration, with a few being rectangular. A gas generator is used for inflation of the bladder. However, the current systems tend to utilize extremely large bladders having long strokes to obtain relatively low acceleration loads. This results in a very inefficient system that does not control the acceleration loads in a predictable and tailored fashion.

Current inflatable systems utilize either basic gun propellants or other propellants in a pellet configuration which burns in a regressive or neutral manner.. This type of propellant burning profile normally produces a regressive flow of gas into the inflatable device. This is the opposite of the most desirable flow because the contact surface area, or footprint area, of the bladder to the munition is usually decreasing with time, which requires an increase in bladder pressure to maintain a near constant or increasing acceleration level. None of the systems heretofore developed reliably provide for constant or tailored acceleration.

Current systems further utilize more propellant than necessary to obtain the amount of gas necessary in the initial phase of the ejection process. This can be seen by examining pressure traces for inflatable bladders which show the pressure continuing to increase after the munition has been ejected. This indicates the propellant is still burning.

It is an object of this invention to provide a system for ejecting munitions from a housing in a manner whereby acceleration loads can be controlled and tailored.

It is a further object of the invention to provide such a system in which the dynamic characteristics of the inflatable bladder, such as volume and footprint area, can be tailored and controlled.

It is also an object of the invention to provide such a system where the rate of gas flow into the bladder can be tailored and controlled.

It is another object of the invention to minimize the size and weight of hardware needed to accomplish the #functioning of the system.

It is a further object of the invention to provide a system which can be used with inflatable bladders of varying shapes and dimensions.

It is yet another object of the invention to provide a system capable of accommodating various acceleration-sensitive functions, such as munition arming.

SUMMARY OF THE INVENTION

The current invention combines the features of a ballistically tailored propellant grain with control nozzles to provide gases to an inflatable bladder in a manner that permits control and tailoring of the acceleration pulse. According to the present invention, any or all of the propellant, nozzle, and inflatable bladder components of the invention may be adjusted to provide an expected acceleration to the munition and control the acceleration of the munition during ejection.

The propellant grain can be selected according to its properties for generating gas. Different propellants will provide different gas flow rates, and those flow rates can be increasing, constant, or decreasing with time.

The nozzles for venting of the gases into the inflatable bladder can be of constant or variable flow area. Variable flow area can be provided in a stepped fashion, with a number of burst disks designed to rupture at progressively high pressures. Constantly variable nozzles, with flow areas which vary with pressure, may also be used.

A final factor in the acceleration of the munition is the inflatable bladder. Varying the size and shape of the bladder affects its volume and footprint relationship to the munition. The inflatable bladder may therefore be selected with gas flow characteristics in mind, in order to achieve a desired acceleration profile.

These components are selected, according to the invention, to provide an acceleration profile which matches the requirements of the particular munition being used. By using the acceleration control techniques taught by this invention, the munition launch may be tailored to avoid damage to the munition or to perform positive functions such as arming the munition.

DESCRIPTION OF THE PREFERRED EMBODIMENTS

Figure 1:
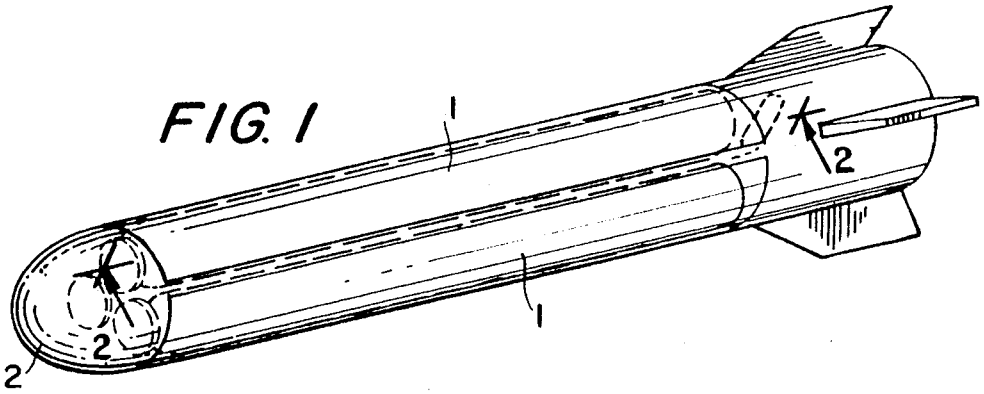
FIG. 1 is a schematic view of the carrier weapon system suitable for use with the invention.

The present invention is suitable for use with munition release systems which employ an inflatable member to eject the munition, including carrier weapons as well as systems structurally fixed to an aircraft. FIG. 1 shows a carrier weapon system according to the invention having three munitions 1, mounted within housing 2. According to the invention these munitions are engaged to the housing at first, and are then disengaged and ejected in response to a release of gas from gas generator 3. Numerous means for carrying out this process are shown in FIGS. 2–18.

Figure 2:
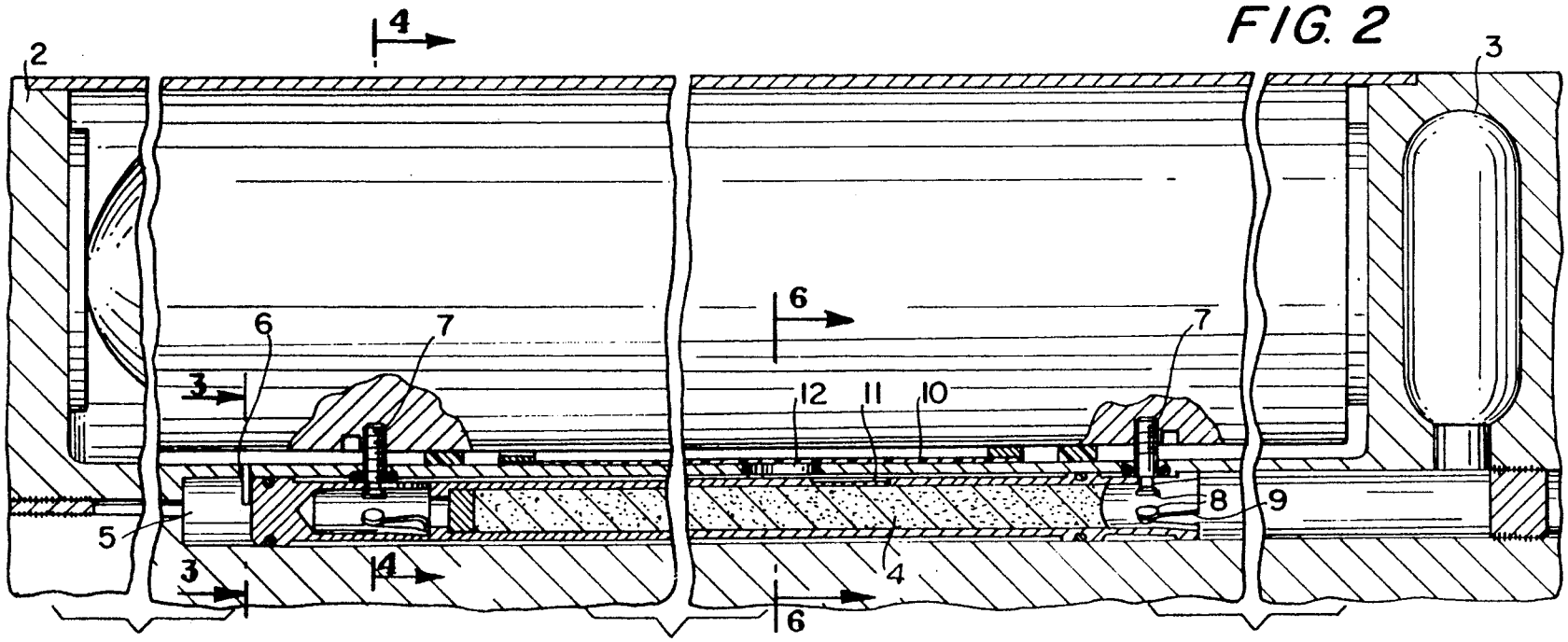
FIG. 2 is a cross-sectional view of the system for disengaging and ejecting munitions according to a first embodiment suitable for use with the invention.

According to the embodiment shown in FIG. 2, the disengagement and ejection of the munition is accomplished through use of a piston 4 within channel 5 of the housing. The piston is disposed to receive gas from the generator 3 and is forced toward the front of the weapon in response to a release of gas; equivalent configurations could be used which force the piston to the rear.

Figures 3, 4:
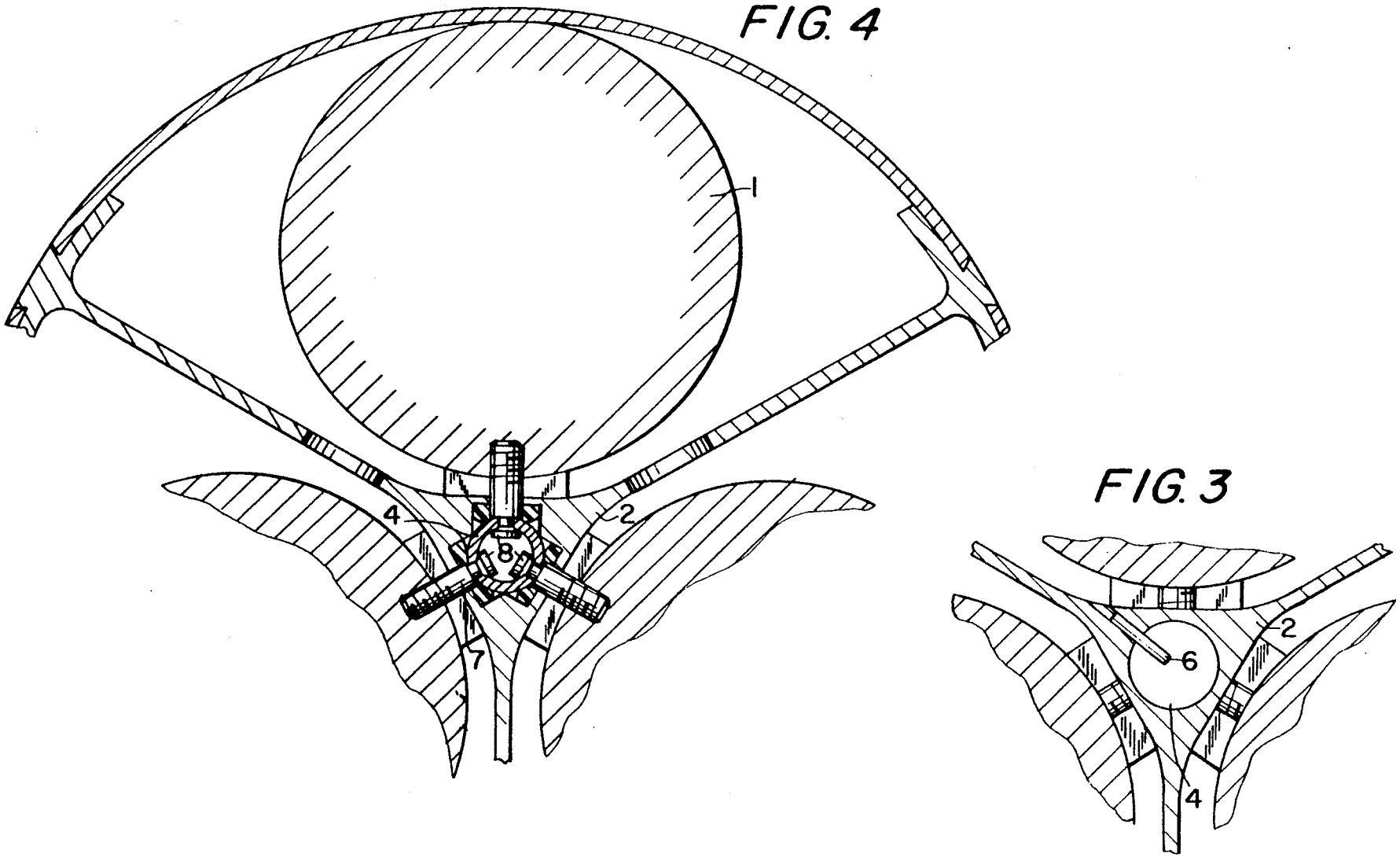
FIG. 3 shows a cross-sectional view of the first embodiment suitable for use with the invention along lines 3—3 of FIG. 2, at the shear pin.
FIG. 4 shows a cross-sectional view of the first embodiment suitable for use with the invention along lines 4—4 of FIG. 2, at the forward engaging lock pins.

A shear pin 6 is used to initially restrain piston 4, and is designed to fracture at a predetermined level of force on the piston from the release of gas. FIG. 3 shows a detailed view of the shear pin mounted within the housing 2 and restraining the forward end of piston 4.

The munition 1 is engaged to the housing 2 by means of lock pins 7, as shown in FIG. 2. One end of the lock pins is permanently mounted on the munition, while the other end is releasably engaged to the piston 4. FIG. 4 shows this mounting arrangement of the three munitions. Lock pins 7 are engaged to piston 4 by pin heads 8. The pin heads interlock with slots 9 in the piston, as shown in FIG. 2.

An inflatable bag 10 is used to eject the munition from the housing. Inflation is achieved through the release of gas from gas generator 3. The disengagement and ejection steps are therefore performed in response to a common energy source. The gas reaches bag 10 through burst disc 11 and burst port 12. Burst disk 11 is a structurally weakened portion of piston 4, which may initially be out of alignment with burst port 12 of the housing. The burst disk would then be aligned with the burst port when the piston shifts in response to the release of gas.

Figure 5:
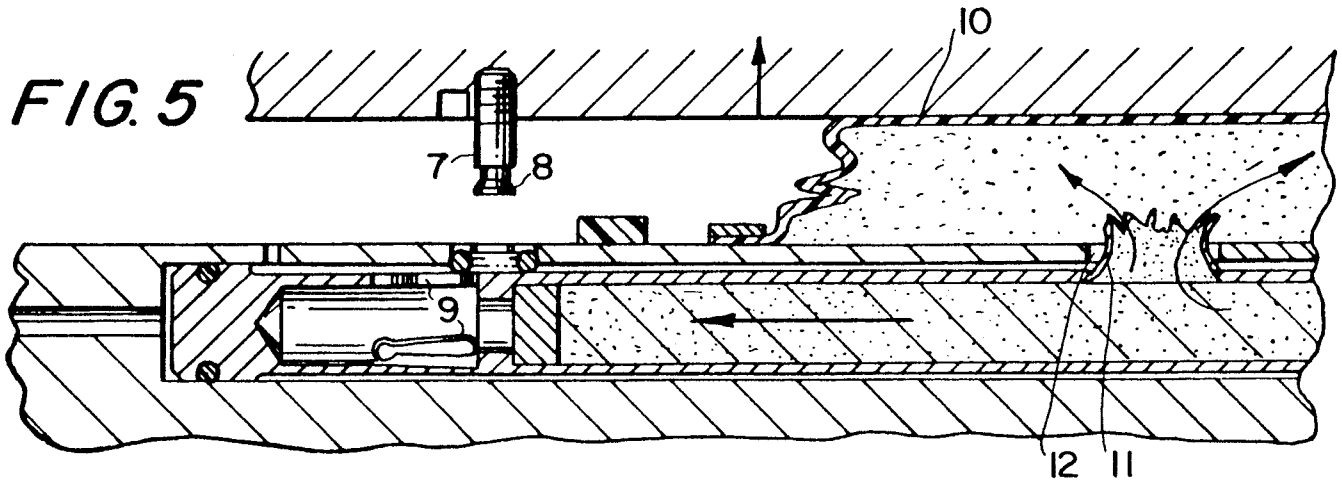
FIG. 5 is a cross-sectional view of the first embodiment suitable for use with the invention, similar to that of FIG. 2, showing the invention after disengagement and in a partially inflated state.

FIG. 5 shows the operation of the first embodiment suitable for use with the invention in response to the release of gas. Once a sufficient level of force is exerted on the piston, the shear pin fractures and the piston moves from the first position of FIG. 2 to a second position as shown in FIG. 5. Disengagement of lock pins 7 is effected by this movement of the piston because the slots 9 with which the pin heads 8 interlock are wider at one end than the other. Thus, the lock pins and the munition are released when the piston moves from the first position, where the narrow ends of the slots engage the pin heads, to the second position, where the wide ends of the slots do not engage the pin heads.

Inflation of the bag 10 occurs when burst disk 11 aligns with burst port 12 as a result of the piston moving from a first to a second position, and further when enough pressure has built up in the piston to burst the disk. By coordinating the structural strength of the shear pin 6 and burst disk 11, and by locating the burst disk along the piston to align with the burst port only in the second position of the piston, it is possible to select the timing of disengagement and ejection as desired.

Alternatively, the system could function without a burst disk 11 by merely assuring a sufficient seal between piston 4 and channel 5 so that gas does not enter the bag 10 prematurely. Alternatively, the system could function without a burst disk 11 by merely assuring a sufficient seal between piston 4 and channel 5 so that gas does not enter the bag 10 prematurely. Preferably the ejection occurs shortly after disengagement, in order to provide the smoothest launch of munitions.

Figure 7:
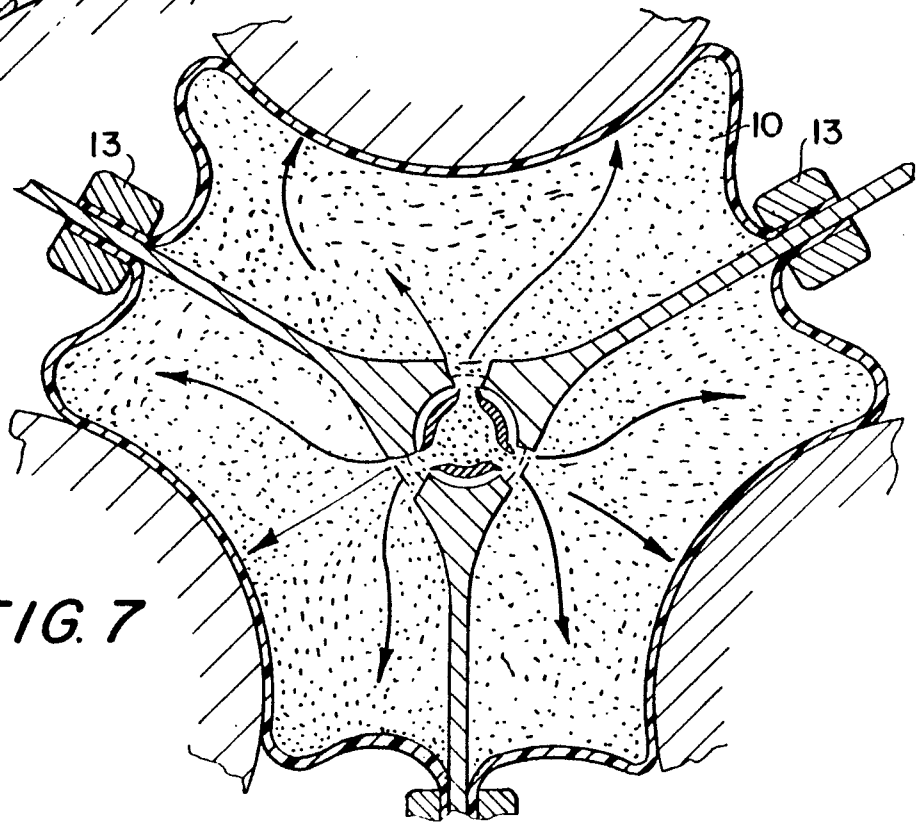
FIG. 7 is a cross-sectional view of the inflatable bag mechanism suitable for use with the invention, similar to that of FIG. 6, shown in a partially inflated state.
Figure 6:
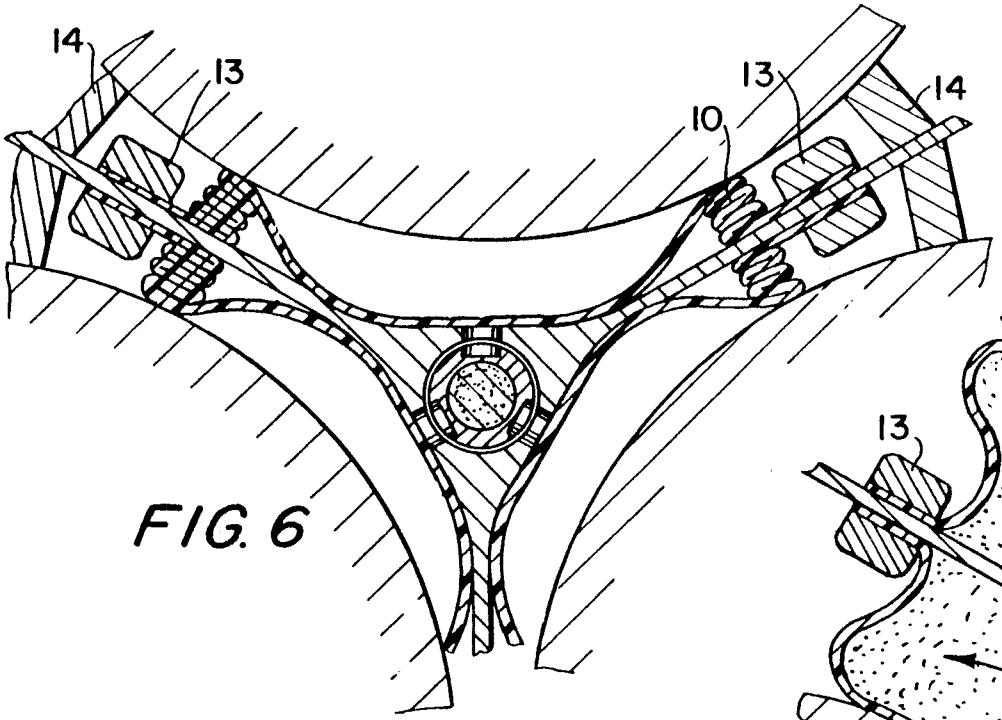
FIG. 6 is a cross-sectional view of the inflatable bag mechanism suitable for use with the invention, taken along lines 6—6 of FIG. 2.

FIGS. 6 and 7 show the inflatable bag 10 suitable for use with the invention before and during inflation, respectively. Securing means 13 sealingly connect the bag to the housing. Securing means 13 may consist of a metal strip or bar around the perimeter of the bag and fixed to the housing, as shown in FIGS. 6 and 7, or may be any of a number of means for sealingly mounting such a bag which would be apparent to one skilled in the art. Before ejection, the bag 10 is collapsed as shown in FIG. 6. Preferably, the munition rests on support structures 14 rather than on the bag, to prevent damage to the bag.

Figure 8:
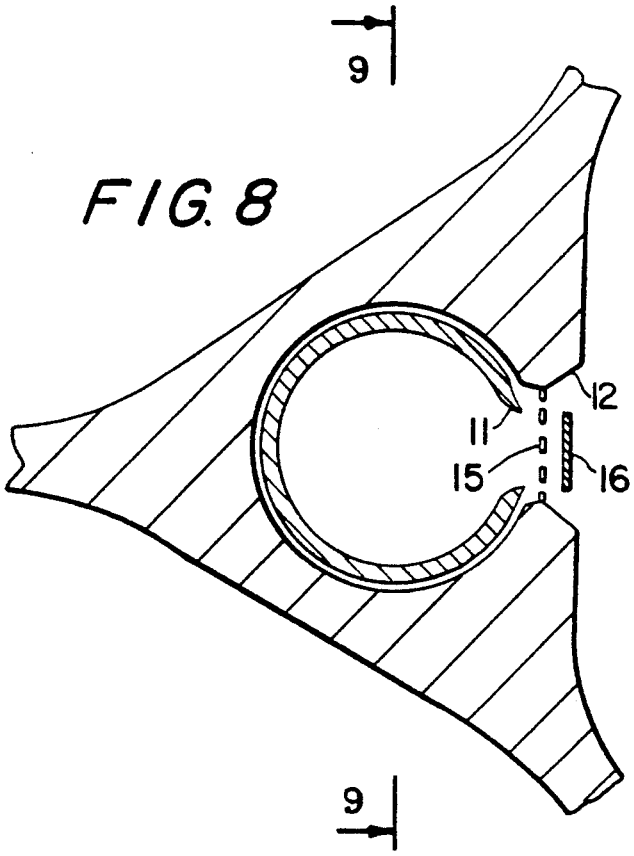
FIG. 8 shows a cross-sectional view of one possible means for controlling the flow of gas into the inflatable bag.
Figure 9:
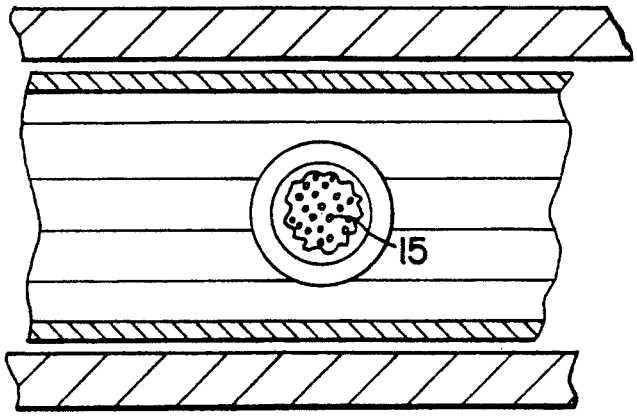
FIG. 9 shows a cross-sectional view of means for controlling the flow of gas into the inflatable bag, taken along lines 9—9 of FIG. 8.

FIGS. 8 and 9 show detailed views of a burst disk 11 and burst port 12, after disk 11 has burst. Preferably a screen 15 and baffle 16 are located in the burst port, to protect the inflatable bag from damage caused by the stream of gas. The screen protects the bag from particles in the gas stream, while the baffle deflects the gas and protects the bag from the heat of the gas by preventing direct impact with the bag and by cooling the gas.

Figure 10:
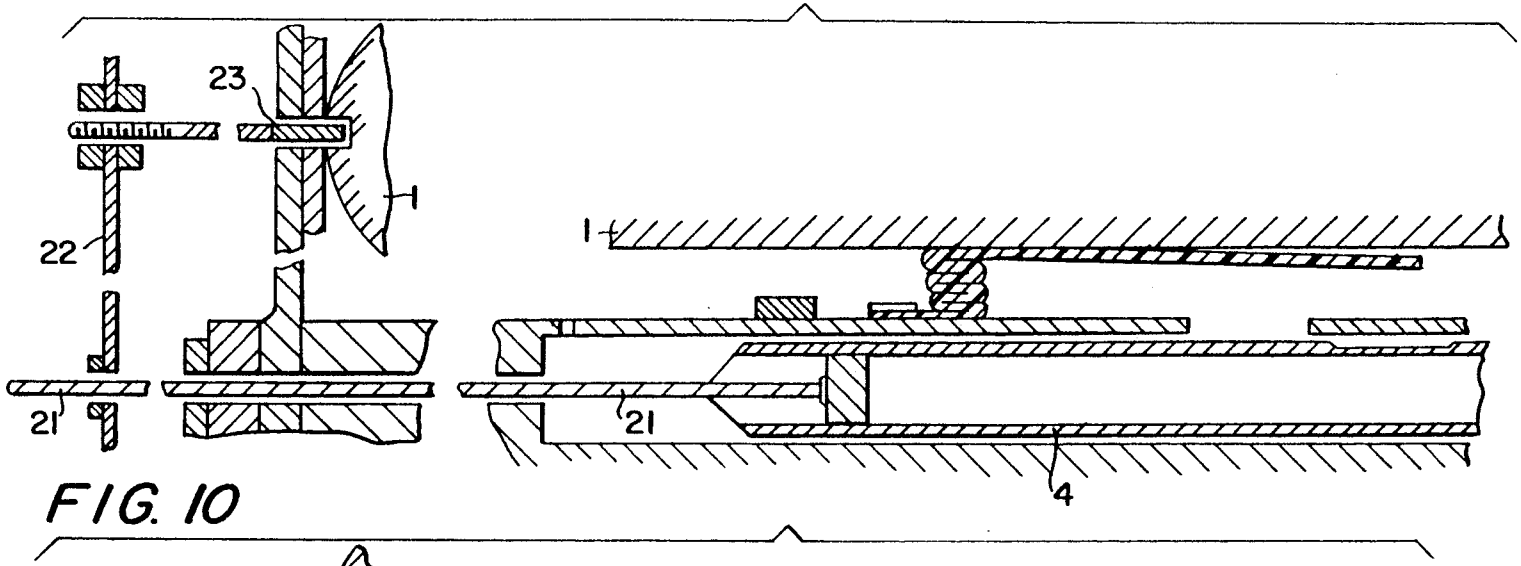
FIG. 10 is a cross-sectional view of the system for disengaging and ejecting munitions according to a second embodiment suitable for use with the invention.
Figure 11:
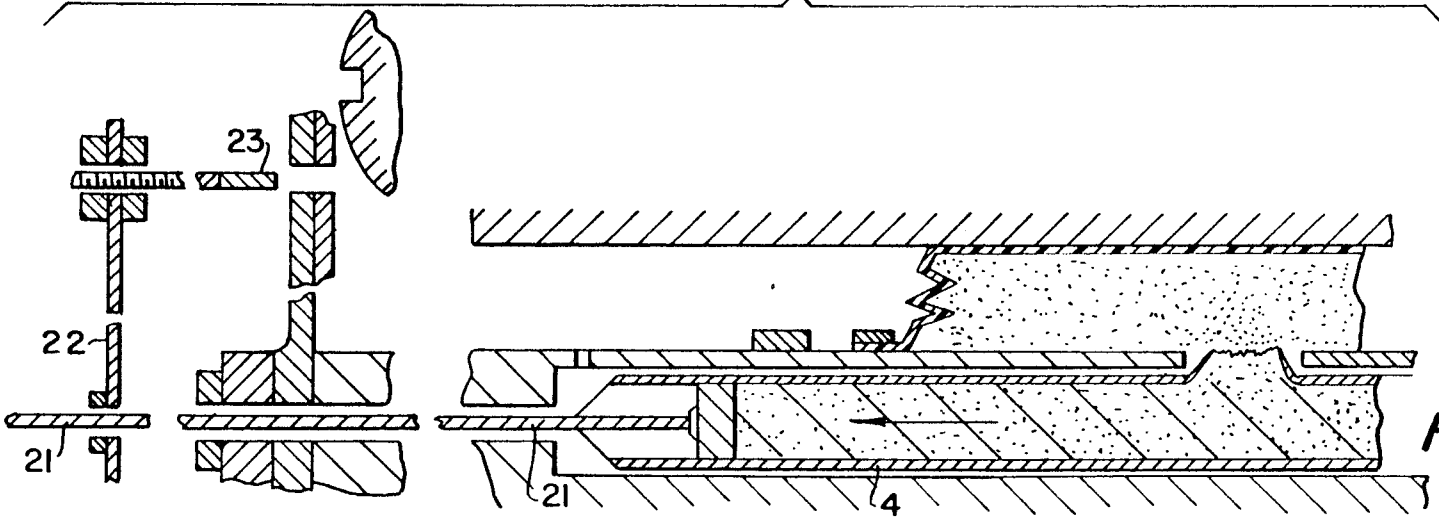
FIG. 11 is a cross-sectional view of the second embodiment suitable for use with the invention, similar to that of FIG. 10, showing the invention after disengagement and in a partially inflated state.

Another embodiment for engaging the munition to the housing is shown in FIGS. 10 and 11. In this embodiment suitable for use with the invention, a pushrod mechanism is used to secure and release the munition 1. Rod 21 is connected at a first end to the forward end of piston 4, and at a second end to the center of plate 22. Another rod 23 is connected toward the periphery of the plate for each munition which is to be released. This rod 23 is inserted into a receptor 24 in the nose of munition 1, thereby securing the forward end of the munition. When piston 4 moves to its second position as shown by FIG. 11, the rod withdraws from the receptor 24 and disengages the munition.

This rod 23 may be used to secure the forward end of the munition, while the rear end is secured by an additional rod member, a locking pin as disclosed previously, or other means such as a spring-loaded pressure plate against the rear of the munition. The inflatable bag operates in the same manner as previously discussed to eject the munition.

Figure 12:
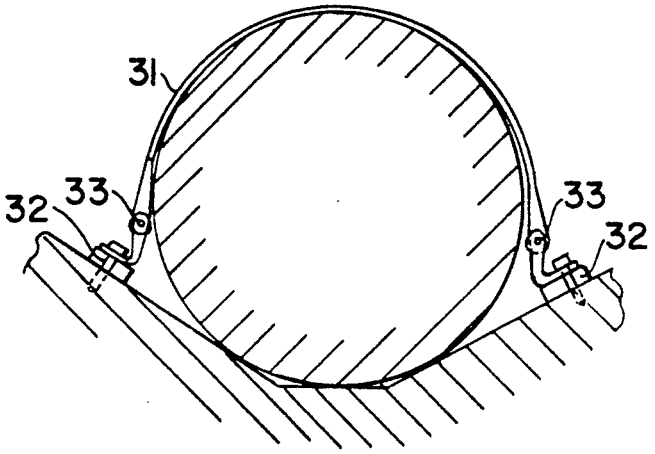
FIG. 12 is a cross-sectional view of the engagement mechanism according to a third embodiment suitable for use with the invention.
Figure 13:
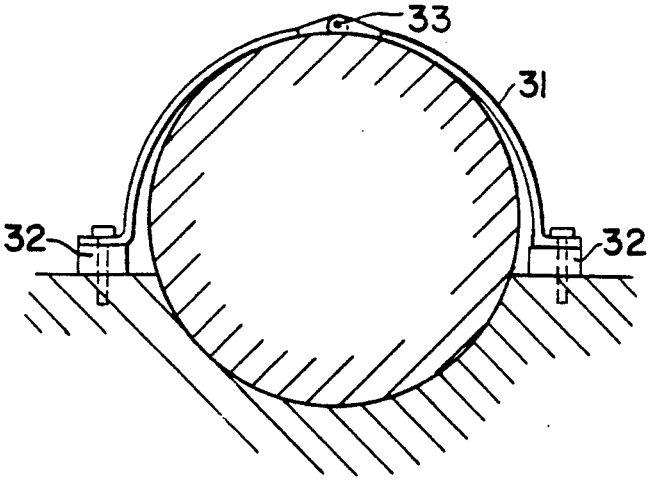
FIG. 13 is a cross-sectional view of the engagement mechanism according to a fourth embodiment suitable for use with the invention.
Figure 14:
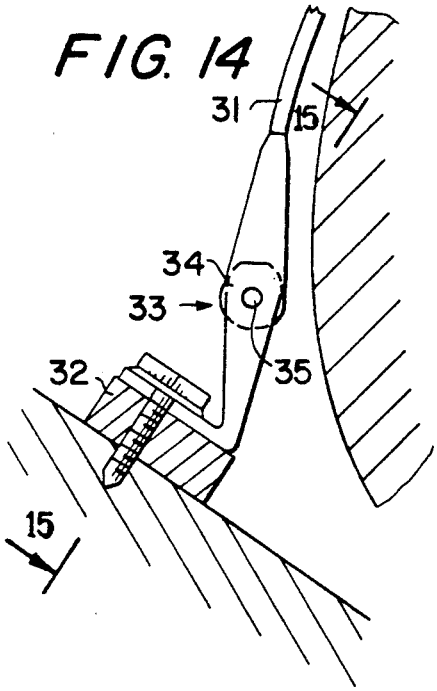
FIG. 14 is a detail view of the engagement mechanism according to the third embodiment suitable for use with the invention shown in FIG. 12.
Figure 15:
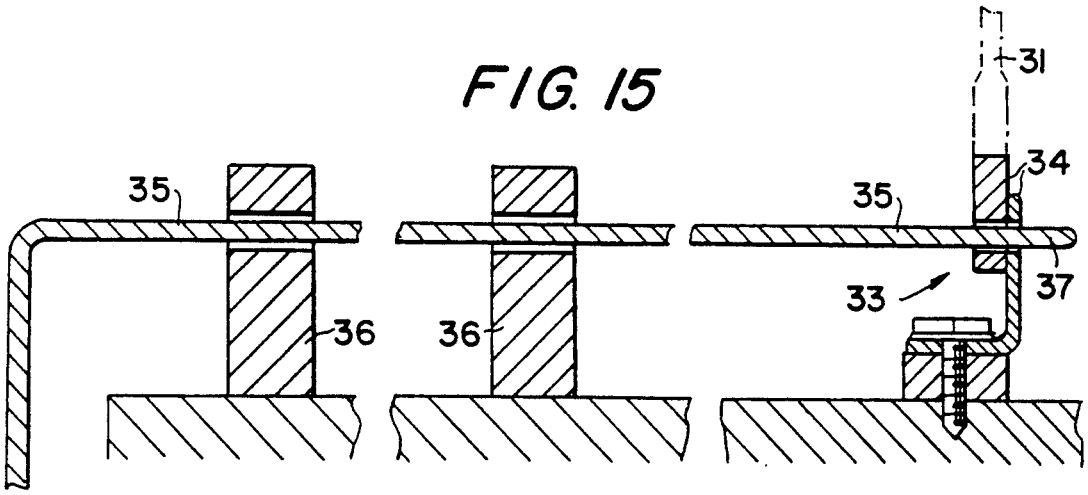
FIG. 15 is a cross-sectional view of the engagement mechanism according to the third embodiment suitable for use with the invention, taken along lines 15—15 of FIG. 14.

Further embodiments suitable for use with the invention are shown in FIGS. 12 and 13, respectively. These embodiments both employ a strap 31 or similar restraining means wrapped around the munition 1. The strap 31 is anchored to the housing on both sides of the munition at anchors 32. Along the straps between the anchors is at least one juncture 33 joining two or more sections of the strap together in restraint of the munition. FIGS. 14 and 15 show one such juncture in detail. The strap sections on either side of the juncture have eyelets 34 aligned with and adjacent to one another. A rod means 35, similar to that used in the embodiment of the invention shown in FIGS. 10 and 11, is inserted through the eyelets to join the strap sections together. Because the rod in these embodiments extends along the length of the munition, unlike the embodiment of FIGS. 10 and 11, it may be desirable to use guide supports 36 to stabilize the rod. Movement of the piston from its first position to its second position withdraws the end 37 of the rod from the eyelets 34, thereby separating the strap sections from each other and enabling the munition to be disengaged from the housing by the airbag.

Figure 16:
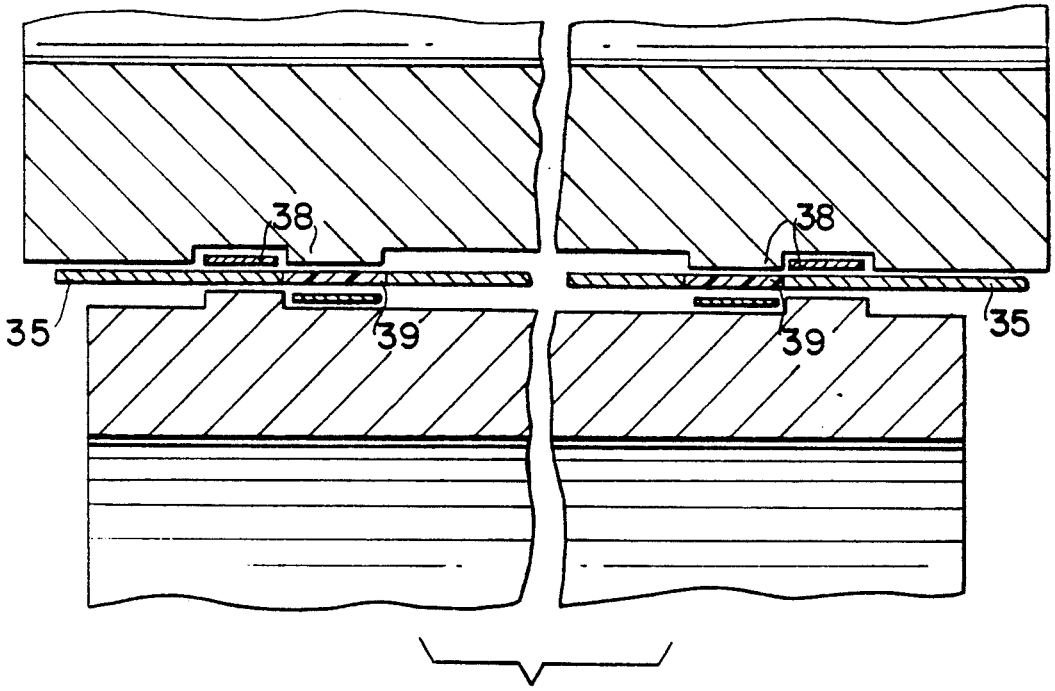
FIG. 16 is a cross-sectional view of an engagement mechanism useful in the third and fourth embodiments suitable for use with the invention.

Another means for joining and separating the strap sections from one another is shown in FIG. 16. Tabs 38, similar in function to the eyelets shown in FIGS. 12–15, are employed. Instead of withdrawing the end of the rod from the tabs, weakened sections 39 of the rod are designed to be moved into alignment with the tab 38 when tension is exerted on the rod by movement of the piston. These weakened sections are preferably formed of plastic. Once in position the major restraint strength has been removed and the weakened sections 39 can be broken by the ejection action of the bag and munition with minimal shock to the munition.

Figure 17:
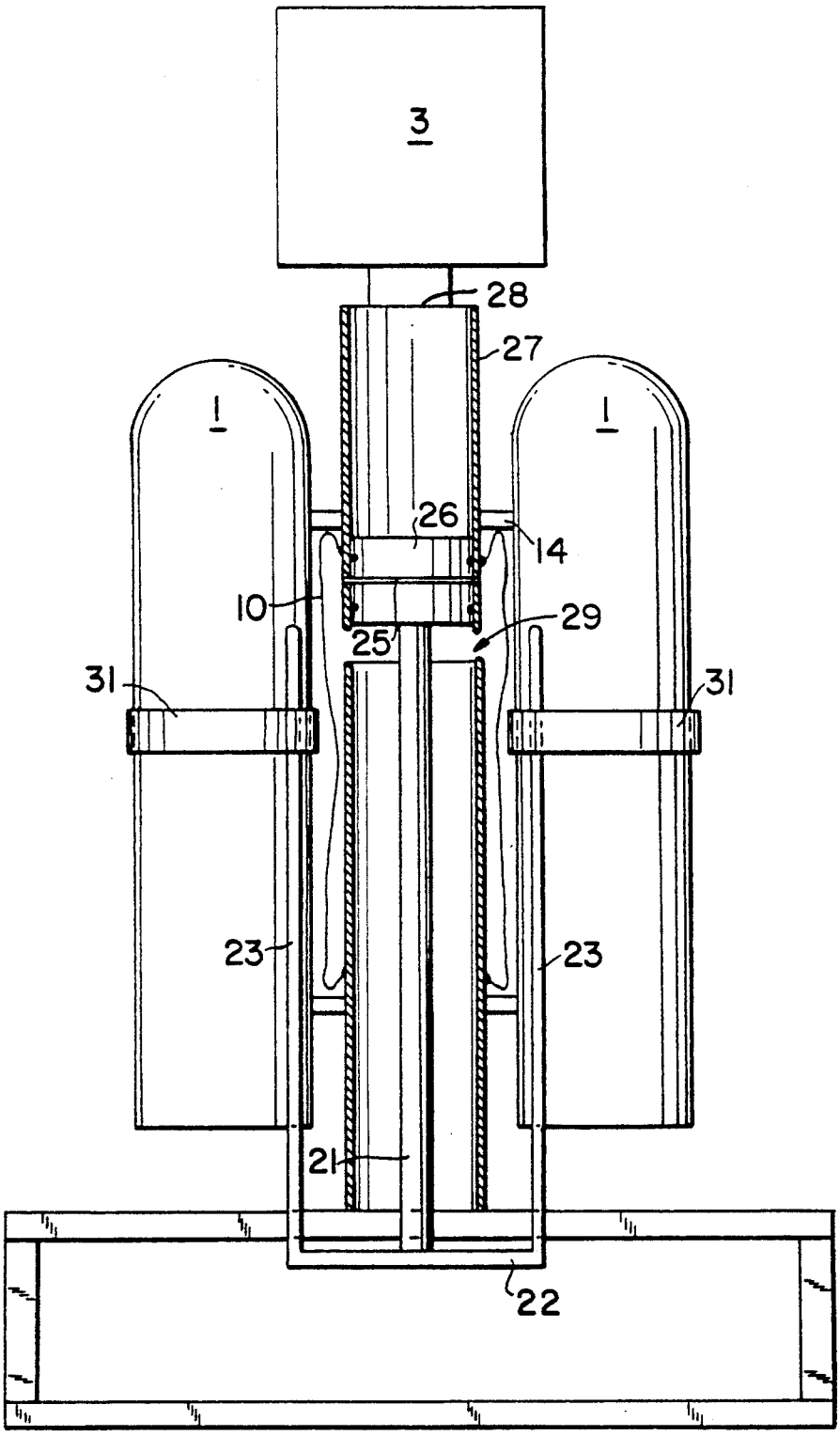
FIG. 17 is a cross-sectional view of the engagement mechanism according to a fifth embodiment suitable for use with the invention, similar to that of FIGS. 12–15.
Figure 18:
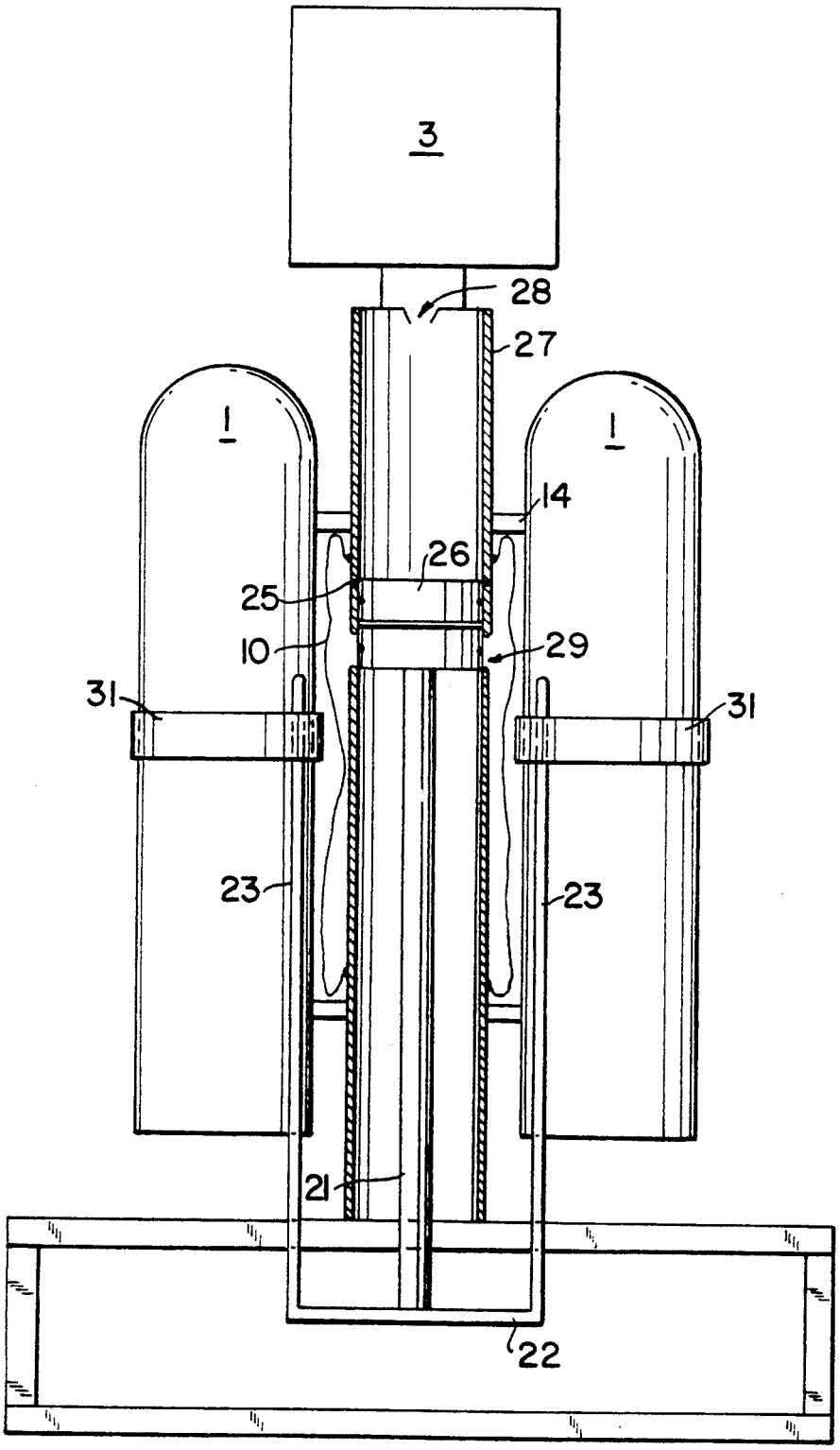
FIG. 18 is a cross-sectional view of the engagement mechanism according to the sixth embodiment suitable for use with the invention, similar to that of FIG. 17, showing the mechanism after a release of gas and before ejection.
Figure 19:
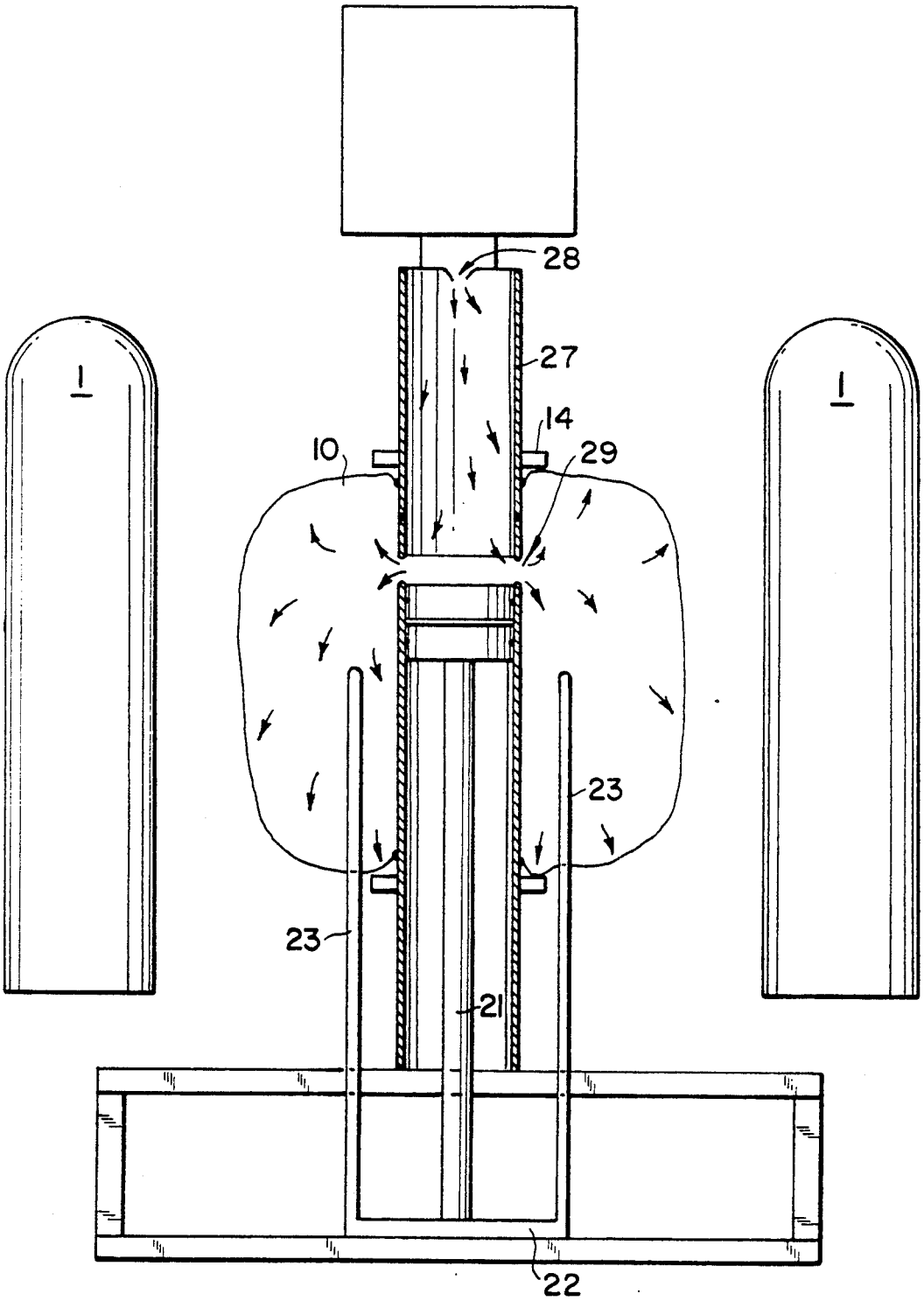
FIG. 19 is a cross-sectional view of the engagement mechanism according to the fifth embodiment suitable for use with the invention, similar to that of FIG. 17, showing the mechanism after ejection.

Yet another embodiment of the invention is shown in FIGS. 17 through 19. FIG. 17 shows the invention before the release of gas, while FIGS. 18 and 19 show the invention during and immediately after inflation of the bag, respectively. As shown in FIG. 17, the munitions 1 rest on supports 14 and are held in place by straps 31. Straps 31 are engaged by rods 23 connected to plate 22, which is connected to piston rod 21. Piston rod 21 is engaged to piston 26, which is movable within channel 27. Piston 26 moves from a first position to a second position within channel 27 in response to the entry of gas into channel 27 from gas generator 3. Burst disk 28 prevents entry of gas into channel 27 until a predetermined pressure is reached. When disk 28 bursts and piston 26 moves within channel 27, rods 23 disengage from straps 31, releasing the munitions The munitions are ejected when piston 26 has moved past gas ports 29, as shown in FIG. 21, allowing gas to inflate bags 10.

The timing of the disengagement and ejection events is coordinated by the use of a shear pin 25 to restrain piston 26 in a first position within channel 27 until a predetermined pressure is reached on the piston. Timing is further affected by the geometric relationship between the piston 26 and the gas ports 29 as the piston moves past the gas ports.

Figure 20:
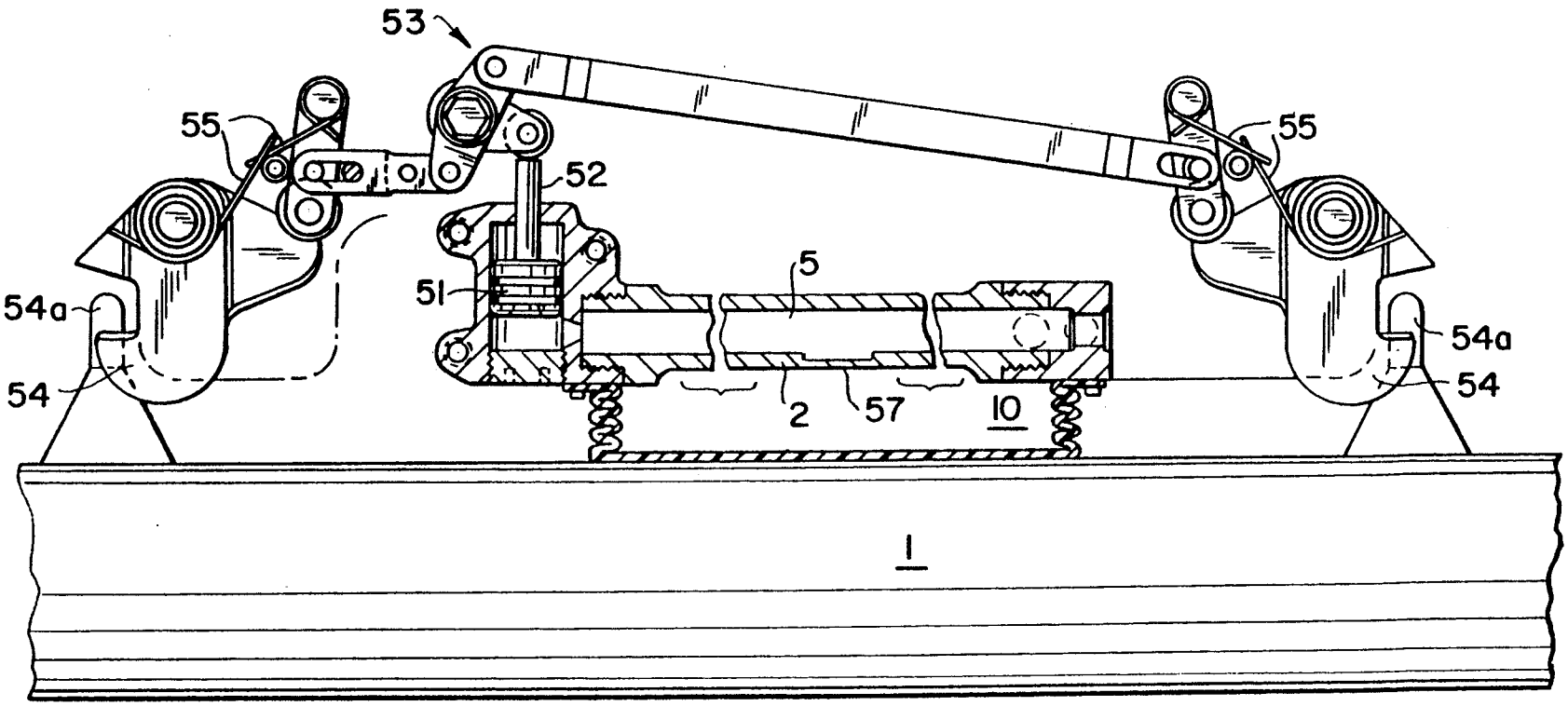
FIG. 20 is a cross-sectional view of the engagement mechanism according to a sixth embodiment suitable for use with the invention.
Figure 21:
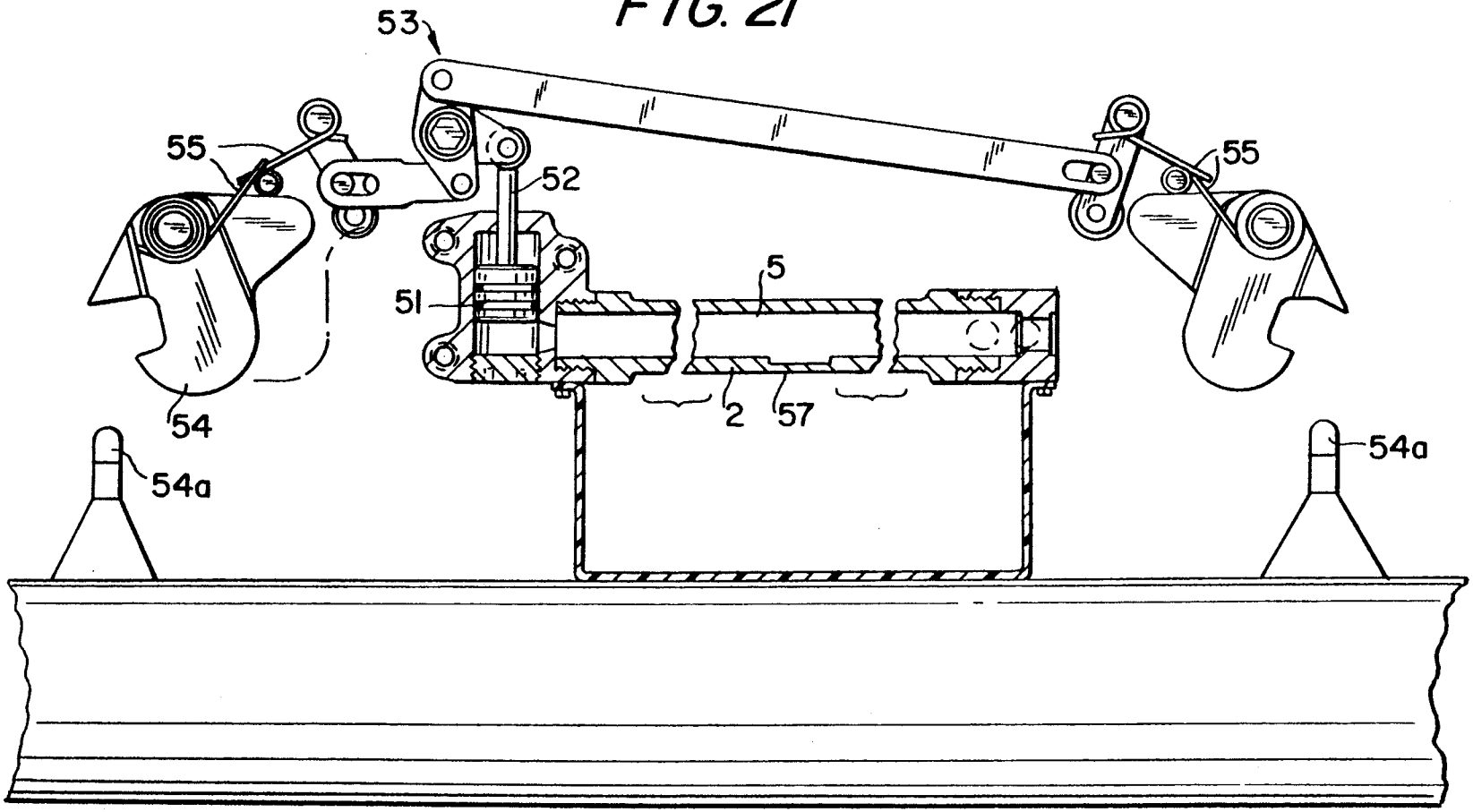
FIG. 21 is a cross-sectional view of the engagement mechanism according to the sixth embodiment suitable for use with the invention, similar to that of FIG. 20, showing the mechanism after ejection.
Figure 22:
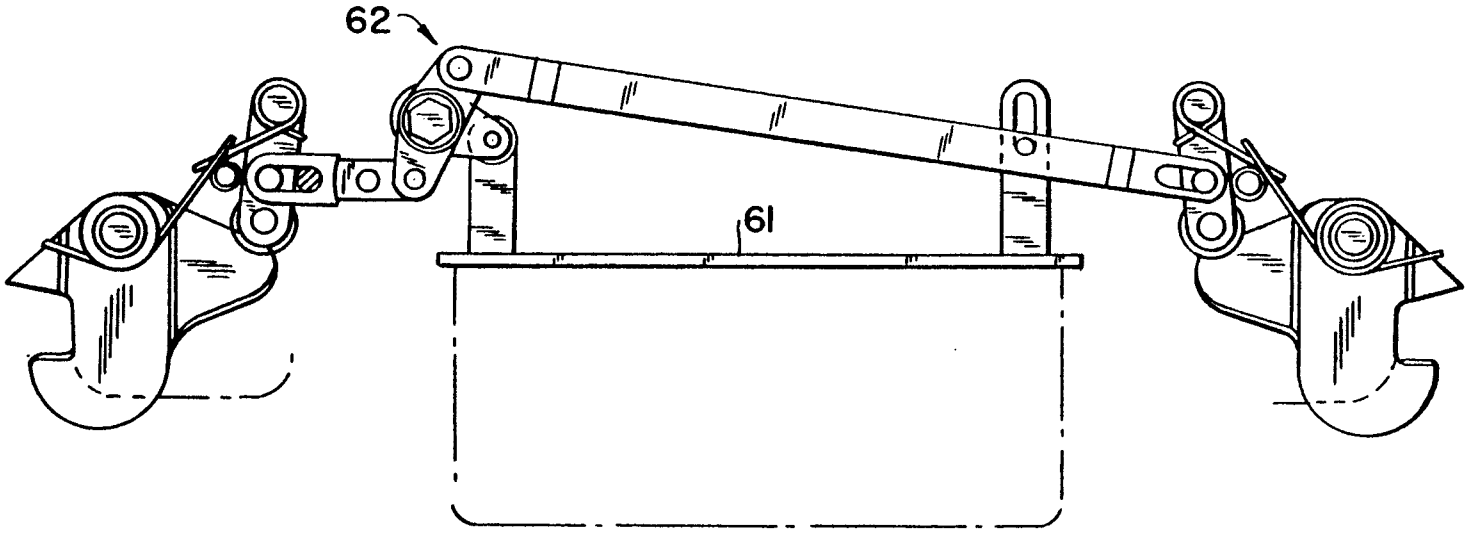
FIG. 22 is a cross-sectional view of the engagement mechanism according to a seventh embodiment suitable for use with the invention.

FIGS. 20–22 depict further embodiments suitable for use with the invention, each of which may be used as part of a carrier weapon system or as part of a weapon release system on board an aircraft. Such on-board uses would include mounting under the wings or fuselage, or in the bomb bays, of airplanes or helicopters. In these cases, the housing which carries the munition is not a carrier weapon but a structural attachment of the aircraft which is not itself released from the aircraft.

In FIGS. 20 and 21, piston 51 is displaced in response to the release of gas from the generator. Pushrod 52 sets linkage 53 in motion, which in turn moves latch means 54 inward. These latch means engage a munition 1 until opened inwardly, at which time the munition is released, as shown in FIG. 21. Normally the latch means are urged outwardly by springs 55, as shown in FIG. 20.

In conjunction with the piston which disengages the munition, an inflatable bag 10 is used to eject the munition This operates in the same manner as the inflatable bag ejection mechanism disclosed previously. However, a burst disc 57 or similar pressure-operated valve is disposed in the housing 2 and not in a piston, because there is no piston within channel 5 in this embodiment. As a result the burst disk is exposed to gas pressure throughout the disengagement step, and the coordination of the burst disk strength with the pressure at which piston 51 operates to release the munition determines the relative timing of the disengagement and ejection events. Alternatively, the system may be provided with a second burst disk 58 at the end of channel 5 to control the timing of the events. Burst disk 58 would be of a lower burst pressure than burst disk 57 in order to release the munition before ejecting it.

FIG. 22 illustrates yet another embodiment suitable for use with the invention. Inflation of the bag exerts pressure against plate 61, setting linkage 62 in motion. The bag is mounted so that it also inflates in a direction away from plate 61, in order to eject the munition. Timing of the disengagement and ejection steps here depends upon the resistance of plate 61 and linkage 62. By minimizing that resistance, the ejection process is smoothed.

The use of "soft munitions" which are highly sensitive to the acceleration loads exerted during ejection has necessitated special attention to the ejection process, regardless of which particular embodiment is used. Because the contact surface area (foot print) between the munition and the pushing media (inflatable bladder) is constantly changing, it is desirable that the flow of gases into the bladder be controlled to yield a volume/-footprint relationship of the bladder which produces the desired acceleration for the ejection process. The product of pressure and footprint area represents the acceleration; a constant product thus represents constant acceleration. For some munitions the acceleration desired may be near constant at the lowest acceleration level possible, while in other cases it may be desirable to shape the acceleration to perform a specific function related to the munition being ejected (e.g., arming).

By controlling the rate of gas flow into a given bladder, the pressure in the bladder can be controlled. The footprint of the bladder is a function of the characteristics of the bladder and of the pressure within the bag. Controlling the gas flow, and selecting the bag characteristics and the means of disengaging the munition, therefore controls the rate of change of the bag characteristics, and the acceleration.

Figure 23:
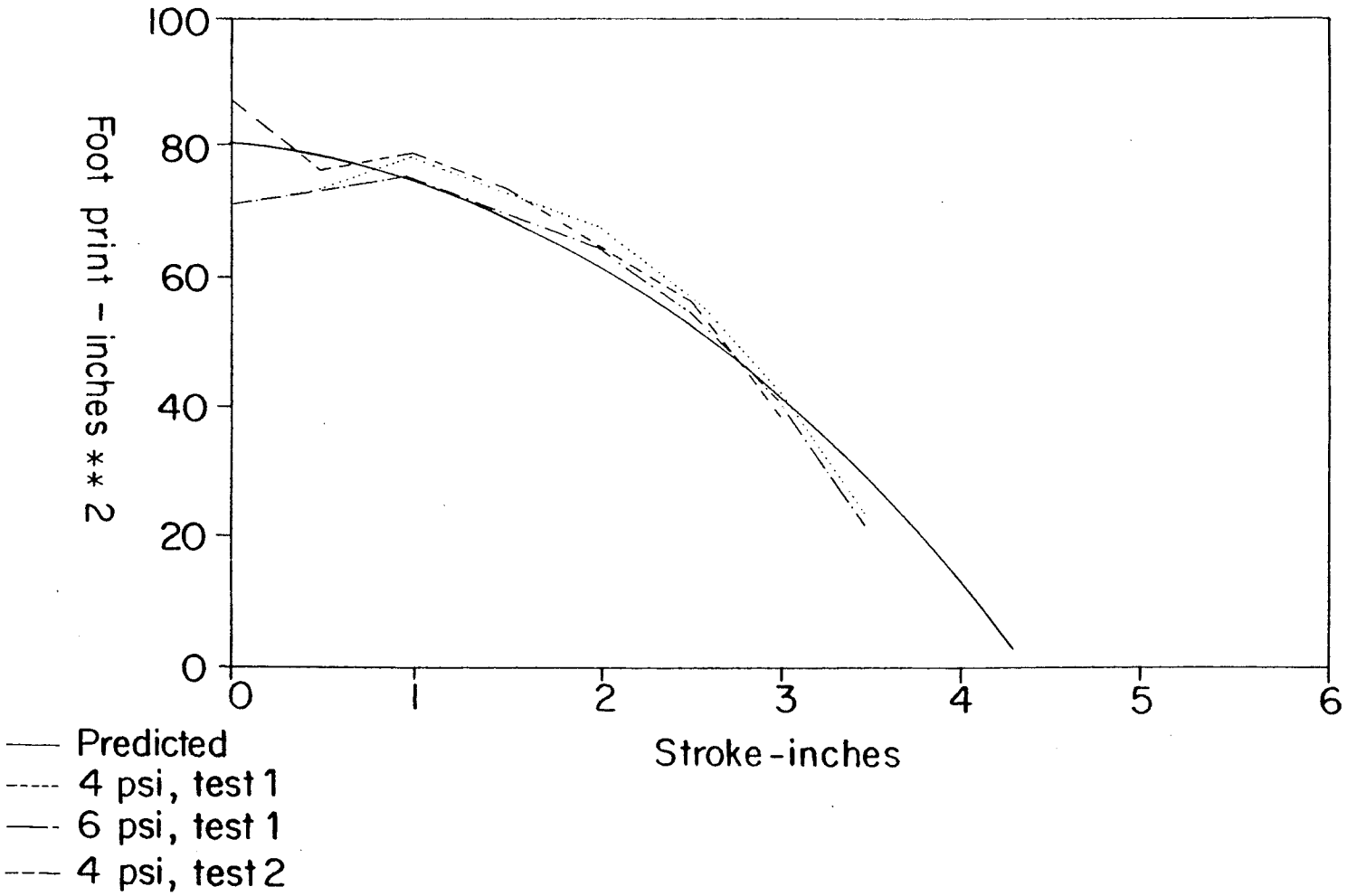
FIG. 23 is a graph showing the footprint area of a bladder as a function of stroke.

FIG. 23 demonstrates that the footprint of a bladder decreases with the distance of travel from its initial position, or stroke. This is elementary, since the contact area between a munition and a deflated bag must be greater than the contact area when the bag is inflated. As a result, maintaining a constant acceleration would require an increasing pressure.

The size and shape of the bladder thus have a direct effect on the acceleration loads imparted to the munition during ejection. Shorter stroke bags require higher pressure to provide the same velocity as a longer stroke bag and therefore involve higher acceleration loads. Bags with smaller contact areas (between bag surface and munition surface) also require higher bag pressures, to provide the same force as a bag having more contact area. The following basic formulas demonstrate these facts:

$$V=\sqrt{2aS}$$

where
V=velocity
a=acceleration
S=stroke
and $$F=P.A$$

where
F=force
P=pressure
A=contact area

Figure 24A:
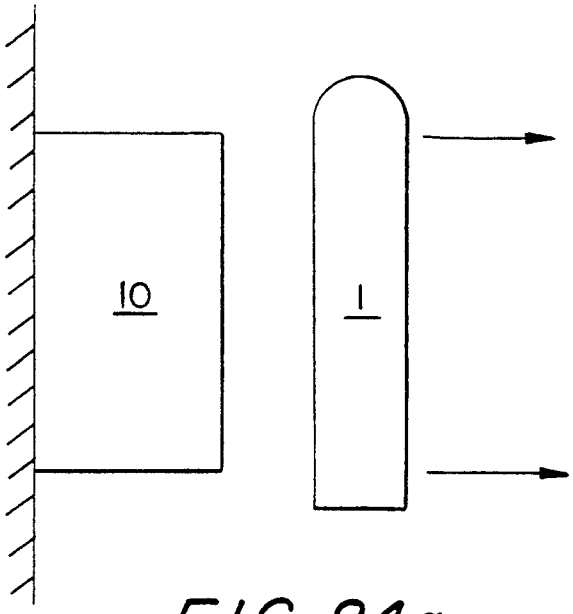
FIGS. 24*a* and 24*b* are cross-sectional views showing the use of differently shaped inflatable bags in the ejection process.
Figure 24B:
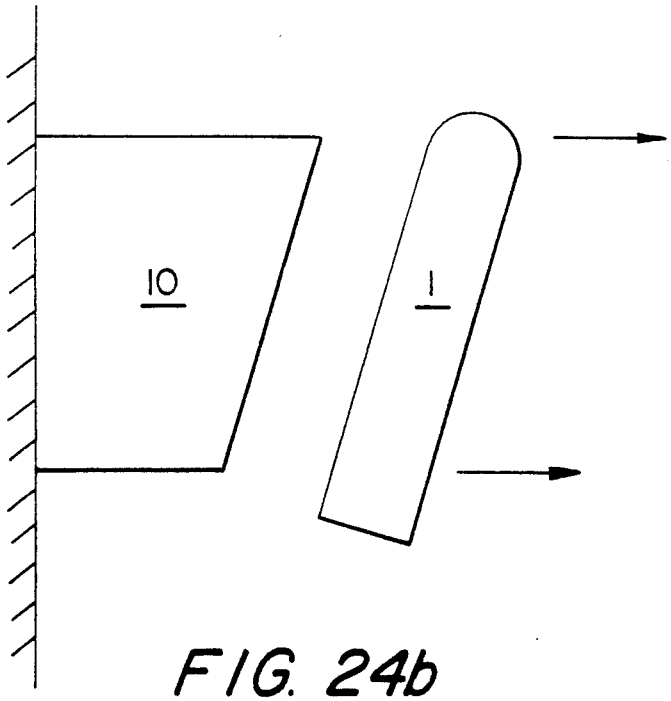

Furthermore, the shape of the bag will influence the attitude of the ejected munition, as shown in FIGS. 24*a* and 24*b*. For example, if the bags are to be designed to push the nose of the munition further than the aft, a definite "nose out" attitude can be induced by using a bag with the configuration shown in FIG. 24*b*.

Currently most inflatable bladders are cylindrical in configuration with a few being rectangular in configuration. Although these are preferred, the bladder configuration used with this invention could be of any cross sectional shape, tailored with other components according to the invention to obtain the desired gas flow characteristics to control acceleration. The bladders are preferably constructed of Kevlar or Nylon cloth.

The rate of gas flow is a function of the pressure in the gas generator and the flow area from the gas generator (nozzle area). There are many different nozzle designs in existence which are suitable for use with this invention. The action of the ejection can be controlled by a fixed nozzle, a nozzle which varies at a known rate, or a nozzle which varies at a known rate dependent on the action of the stroking piston.

Fixed nozzles have been used in the industry for many years and involve designs as simple as a straight hole drilled thru a metal wall, and as complex as expanding a flared nozzle formed from carbon (graphite) or exotic metals (Molybdenum, Tungsten, Vanadium, etc). Burst disks are another type of fixed nozzle, employing a membrane which ruptures at a predetermined pressure to prevent gas flow until a minimum pressure is reached.

A number of burst disks may also be used in combination to effectively provide a variable flow area which increases with increasing pressure. This is accomplished by using a burst disk which ruptures at a first pressure, and additional burst disks which rupture at least at a second higher pressure. Thus, a configuration might be used having 3 steps of flow area. An initial burst disk rupture would provide a first flow area. Once the pressure from the gas generator reached a specific higher point, another burst disk rupture would augment the first flow area. A final, maximum flow area would be reached by a third burst disk rupture, once an even higher pressure was attained. This progression can be provided by using three different burst disks, or sets of burst disks, having succeedingly higher strengths. An incrementally variable flow area is thereby provided, as opposed to constantly variable flow areas which will be addressed next.

Variable nozzles generally have flow areas which expand in response to increasing pressure or as a result of erosion. Where expanding nozzles use an increase of pressure to expand or dilate the nozzle orifice, the orifice itself is usually constructed of a flexible material which will deform at a known rate in response to pressure. The erosive nozzles, on the other hand, are constructed of an ablative material which will erode at a known rate due to the heat, gas velocity and particulate erosion of the combustion products of the gas generator. This erosion action causes the nozzle opening to expand or ablate.

By using a technique similar to that used to unlock the restraint system prior to ejection, control of the nozzle flow area can also be achieved as a function of the piston stroke. Using a slot of known size and configuration a variable area nozzle can be controlled by the slide action of the piston. This type of nozzle is shown in FIGS. 17, 18 and 19, where the gas is trapped behind the piston and is unable to reach the gas ports until the pressured face of the piston moves past those ports. Nozzle area in this configuration is thus a function of the geometric relationship of piston and ports as the piston moves past the ports.

Another factor which affects the ejection of the munition is the type of propellant grain used. A propellant grain with multiple perforations and burning only on the inside diameter of the perforations would provide a progressive gas flow (i.e., an increasing rate of flow), as opposed to the regressive flow of most current systems. The extent of progressiveness is a function of the perforation size and the number of perforations. The same effect could be obtained using many small grains with a single perforation if the burning surface is limited to the inside diameter only. The type of propellant is not critical as long as the hot gases are at a low enough temperature when they reach the inflatable bladder to not damage the bladder. To this end, it is possible to reduce the effect of the hot gas on the bladder by providing a deflector baffle at the port where gas enters the bladder, as discussed above with reference to FIGS. 8 and 9, so that a direct stream of gas does not damage the bladder.

Although the exact type of propellant used is generally not critical to the operation of the invention, the following propellants are noted as examples of those which would be suitable. HTPB, CTPB, and rubber ammonium nitrate propellants are generally suitable. The azide family of propellants, such as those disclosed in U.S. Pat. Nos. 4,758,287 to Pietz and 4,604,151 to Knowlton et al., may be used as well. Other propellant grain configurations which might be used are disclosed in U.S. Pat. Nos. 4,386,569 to Deas, 4,627,352 to Brachert et al., and 4,094,248 to Jacobson; Jacobson would likely be suited for larger payloads.

In accordance with the above description, the present invention selects a combination of inflatable bladder characteristics, nozzle type and area, propellant type and configuration, and munition disengagement mechanism, in order to achieve desired ejection characteristics. The ejection results of the systems can be tailored by adjusting one or several of these parameters. Several combinations of parameters can usually be used to obtain the same results. For example, if a particular system yields a 60 G 15 milli sec sine wave acceleration pulse, a similar result can be obtained by using a faster, more gaseous propellant and increasing the nozzle area to allow the propellant to burn at a lower pressure and therefore lower burn rate. It is also possible to achieve the same result by having a fast burn rate, highly gaseous propellant, while adjusting the size and stroke of the bag instead of the nozzle to achieve the 60 G 15 milli sec sine wave acceleration pulse. Similarly, slower burn rate or less gaseous propellants can be used by making the nozzles smaller or by reducing the size or stroke of the bag.

Location of the gas generator is not critical. It can be located internally within the inflatable bladder, immediately adjacent to the bladder, or remote to the bladder with the hot gases transferred to the bladder via a tube or chamber.

The optimization of a gas generator for a specific application permits the propellant charge to be minimized to the exact amount of propellant necessary to do the job. This in turn minimizes the size and weight of materials necessary to construct the system.

The tailoring of the acceleration trace permits a specific acceleration level to be obtained for a specific time interval. This feature can be combined with an acceleration sensor on the munition to provide an arming function. This type arming feature is currently utilized on missiles where the thrust of a rocket motor provides a unique acceleration signature.

The use and operation of this invention is illustrated by, but not limited to, the following examples. For the tests described below a HTPB propellant grain with fifty seven 0.10 inch perforations was utilized.

Figure 25:
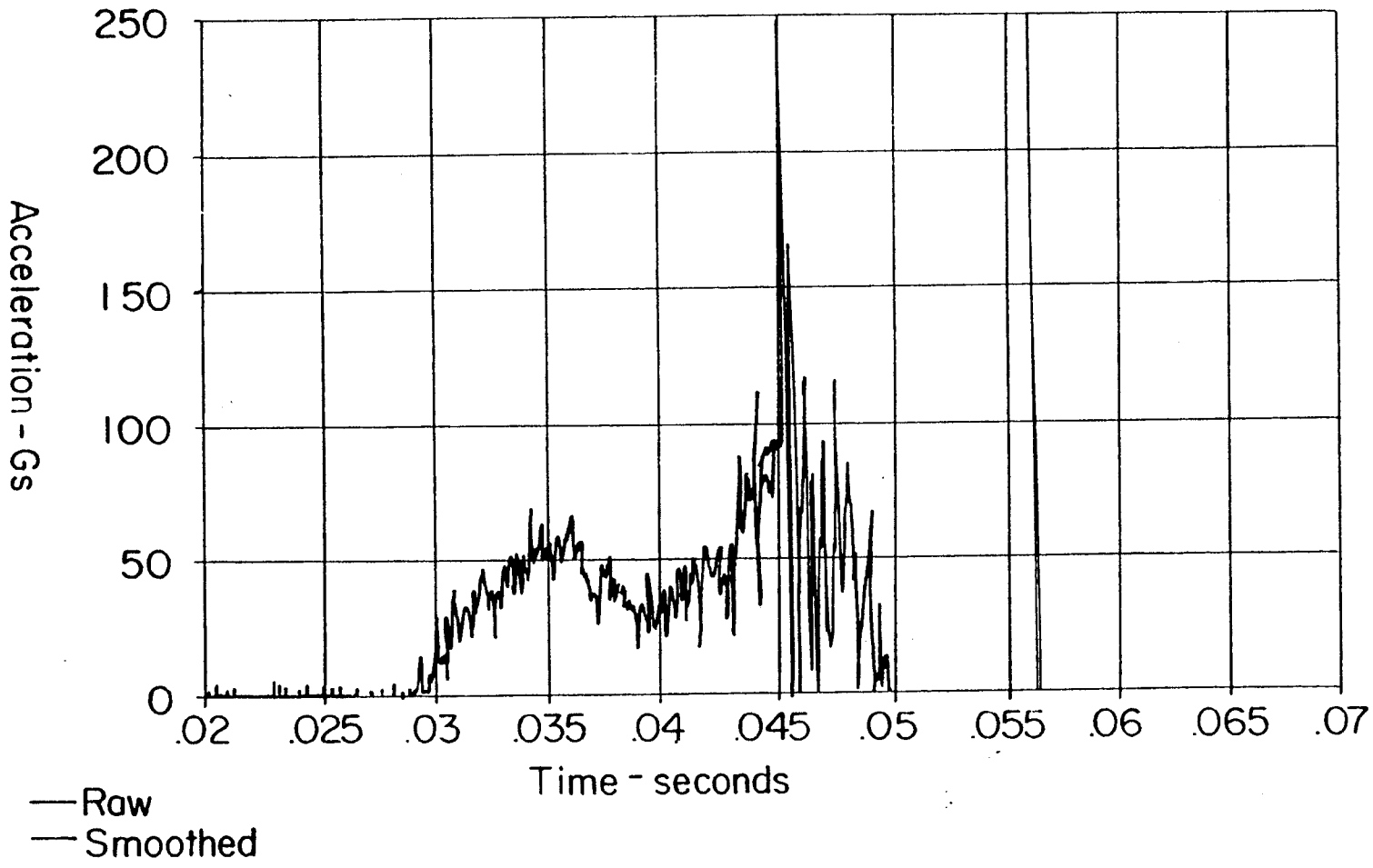
FIG. 25 is a graph showing the acceleration of a munition as a function of time where a variable flow area nozzle is used.
Figure 26:
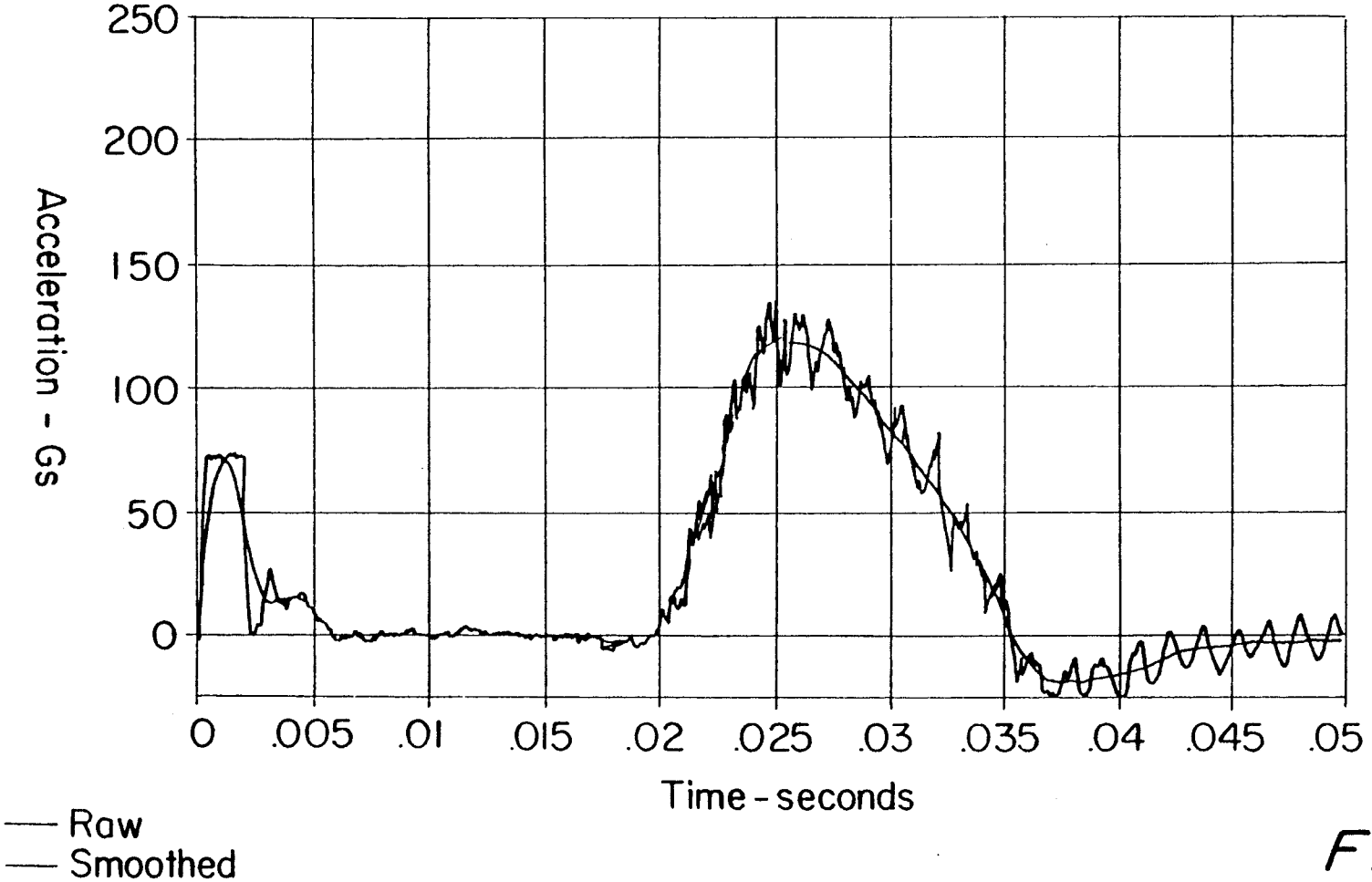
FIG. 26 is a graph showing the acceleration of a munition as a function of time where a constant flow area nozzle is used.

The effect of selecting a constant versus a variable flow area is shown in FIGS. 25 and 26. FIG. 25 presents the results for a test showing the effect of a variable flow area from the gas generator to the inflatable device. FIG. 26 presents the results for a test where the flow area from the gas generator is constant. For both of these tests ejecting velocities of approximately 35 fps were obtained with a 3.5 inch effective stroke employed during the tests. The two acceleration traces demonstrate the principle of controlled accelerations. For the test represented in FIG. 25, the highest acceleration loads are obtained at the end of the stroke and the total curve has two humps. The FIG. 26 test curve is more triangular in shape. By selecting the gas flow area control it is therefore possible to tailor the acceleration of the munition.

Although the various embodiments of the present invention are primarily intended for use in carrier weapon systems, the invention may be used for other munition release applications as well, and is not limited to carrier weapons.

We claim:

1. In a munition ejection system having at least one munition releasably secured to a housing, a gas generator for generating gas, and an inflatable member for receiving gas from said generator and ejecting said munition in response thereto, the improvement which comprises means for controlling the rate of gas flow from the gas generator into the inflatable member the for providing a predetermined acceleration to the munition during ejection, wherein the means or controlling the rate of gas flow comprises a propellant having perforations therein for burning to provide progressive gas generation and an increasing rate of gas flow.

2. The munition system of claim 1 wherein the munition ejection system further comprises an inflatable member configured and dimensioned relative to the characteristics of the gas generator for providing a predetermined acceleration of the munition during ejection.

3. The munition ejection system of claim 2, wherein said propellant is at least one propellant grain having perforations for burning only on the inside diameter of the perforations to provide progressive gas generation.

4. The munition ejection system of claim 1 wherein the gas flow controlling means further comprises at last one valve disposed between said gas generator and said inflatable member.

5. In a munition ejection system having at least one munition releasably secured to a housing, a gas generator for generating gas, and an inflatable member for receiving gas from said gas generator and ejecting said munition in response thereto, the improvement which comprises providing a propellant that burns with progressive gas generation, for providing an increasing of gas flow, and at least one valve between said gas generator and said inflatable member, wherein the propellant, inflatable member and at least one valve are operatively associated in combination for regulating gas flow from said gas generator to said inflatable ember at a desired rate thus controlling the acceleration of the munition during ejection.

6. The munition ejection system of claim 5, further comprising an inflatable member configured and dimensioned relative to the characteristics of the valve for providing a predetermined acceleration of the munition when said inflatable member receives gas from said gas generator.

7. In a munition ejection system having at least one munition releasably secured to a housing, a gas generator having a propellant for generating gas, and an inflatable member for receiving gas from said gas generator and ejecting said munition in response thereto, the improvement which comprises providing an inflatable member configured and dimensioned of a size and shape which in combination with the propellant burn characteristics provides a predetermined acceleration to the munition when said inflatable member receives gas from said gas generator during ejection, wherein the propellant has internal perforations for burning to provide progressive gas generation.

8. The munition ejection system of claims 1, 5 or 7, further comprising an acceleration sensor disposed on the munition for arming said munition in response to acceleration during ejection.

9. The munition ejection system of any of claims 1, 5 or 7, further comprising engaging means for fastening said munition to said housing, and disengaging means for disengaging said munition from said housing in response to a release of gas from said gas generator.

10. The munition ejection system of claim 1, wherein said propellant is selected from the group consisting of HTPB, CTPB, rubber ammonium nitrate, and azide propellants.

11. The munition ejection system of claim 1 wherein the controlling means comprises:

a propellant having predetermined burn characteristics; and at least one valve disposed between the gas generator and the inflatable member;

wherein the inflatable member is configured and dimensioned relative to the burn characteristics of the propellant and operation of the valve for accelerating the munition during the ejection.

12. An apparatus for disengaging and ejecting a munition form a housing comprising:

a housing;

a munition disposed within the housing;

securing means disposed in contact with the munition for securing the munition in the housing;

disengagement means disposed adjacent to the securing means for releasing the securing means from the munition;

ejection means disposed adjacent to the munition for ejecting the munition from the housing;

having a propellant disposed therein a gas generator for producing a pressurized gas;

where the disengagement means and injection means are each capable of being activated by the gas produced by the gas generator; and means for controlling the rate of gas flow from the gas generator to the ejection means the controlling means including at least one valve therein which, in combination with the disengagement means, ejection means sand pressurized gas provides a predetermined acceleration of the munition during ejection.

13. The apparatus according to claim 12 wherein the ejection means is an inflatable member configured and dimensioned relative to the characteristics of the gas generator and the controlling means for providing a predetermined acceleration of the munition during ejection.

14. The apparatus according to claim 12 wherein the controlling means comprises a propellant having predetermined burn characteristics for providing a predetermined rate of gas generation.

15. The apparatus according to claim 12 wherein the controlling means comprises two valves valve disposed between the gas generator and the ejection means.

16. The apparatus according to claim 12 wherein the disengagement means comprises a piston capable of moving from a first position to a second position in response to the generation of gas, wherein the piston triggers the disengagement of the munition from the housing when disposed at the second position.

17. An apparatus for disengaging and ejecting a munition from a housing comprising a housing;

a munition disposed within the housing;

securing means disposed in contact with the munition for securing the munition in the housing;

a generator for producing a pressurized gas means;

means for controlling the disengagement and ejection of the munition, in response to the generation of gas, the controlling means comprising:

an inflatable member disposed adjacent the munition for ejecting the munition upon inflation with the gas;

a piston disposed in the housing capable of moving from a first position to a second position in response to the generation of gas, wherein the piston triggers the disengagement of the munition from the housing when moved to the second position;

a propellant disposed within the gas generator having predetermined burn characteristics for providing a predetermined rate of gas generation; and at least one valve disposed between the gas generator and the ejection means;

wherein the inflatable member is configured and dimensioned relative to the characteristics of the propellant and the valve for providing a predetermined acceleration of the munition during ejection.

18. The apparatus of claim 17 wherein the housing is secured to an aircraft.

19. The munition ejection system of claim 17 wherein the propellant has perforations for burning on the inside diameter of the perforations for providing progressive gas generation.

20. The munition ejection system of claim 5 further comprising means for disengaging the munition from the housing.

21. The munition ejection system of claim 7 further comprising means for disengaging the munition from the housing.

22. The munition ejection system of claim 11 further comprising means for disengaging the munition from the housing.

23. In a munition ejection system having at least one munition releasably secured to a housing, a gas generator for generating gas, and an inflatable member for receiving gas from said generator and ejecting said munition in response thereto, the improvement which comprises means for controlling the rate of gas flow from the gas generator into the inflatable member for providing a predetermined acceleration to the munition during ejection and an acceleration sensor disposed on the munition for arming the munition in response to acceleration during ejection.

24. The munition ejection system of claim 6, wherein said at least one valve comprises at least two burst disks, including a first burst disk adapted to rupture at a first pressure and a second burst disk adapted to rupture at a second pressure higher than the first pressure.

25. The munition ejection system of claim 6, wherein said at least one valve has a variable flow area.

* * * * *